United States Patent [19]

Oschansky et al.

[11] Patent Number: 5,067,708

[45] Date of Patent: Nov. 26, 1991

[54] MULTI-FUNCTION EXERCISE SYSTEM

[75] Inventors: Brad Oschansky, Baltimore; Scott Olschansky, Towson; Raymond H. Lee, Jr., Lutherville, all of Md.

[73] Assignee: Lifeing, Inc., Pikesville, Md.

[21] Appl. No.: 534,879

[22] Filed: Jun. 8, 1990

[51] Int. Cl.[5] ..... A63B 21/062

[52] U.S. Cl. ..... 272/118; 272/134; 272/DIG. 4

[58] Field of Search ..... 272/117, 118, 134, DIG. 4, 272/123

[56] References Cited

U.S. PATENT DOCUMENTS

| | | | |
|---|---|---|---|
| 4,402,504 | 9/1983 | Christian | 272/118 |
| 4,600,189 | 7/1986 | Olschansky et al. | 272/134 X |
| 4,621,807 | 11/1986 | Stramer | 272/117 |
| 4,666,149 | 5/1987 | Olschansky et al. | 272/134 X |
| 4,725,054 | 2/1988 | Solow et al. | 272/134 X |

FOREIGN PATENT DOCUMENTS

| | | | |
|---|---|---|---|
| 2742106 | 3/1979 | Fed. Rep. of Germany | 272/117 |
| 7609655 | 3/1978 | Netherlands | 272/117 |
| 2184953 | 7/1987 | United Kingdom | 272/117 |

*Primary Examiner*—Robert Bahr

*Attorney, Agent, or Firm*—Morton J. Rosenberg; David I. Klein

[57] ABSTRACT

A multi-function exercise system (10) for reversibly displacing weight elements (12) in a substantially vertical direction (14) responsive to a rotative displacement force applied to the actuating arm assembly (38) from an initial position in either of two opposite directions. The exercise system (10) includes a transforming mechanism (100) displaceably coupled to a base frame (18) in order to accommodate the user applying the rotative force to the actuating arm assembly (38). The transforming mechanism (100) includes a rotative displacement member (102) rotatively coupled to the actuating arm assembly (38). Rotative displacement member (102) is coupled to a linear displacement member (104) by a pair of flexible chain members (108) and (110), coupled to opposing sides of rotative displacement member (102). Linear displacement member (104) is slidably coupled to displaceable frame assembly (106) for displacement in an identical direction regardless of the displacement direction of the actuating arm assembly (38) from an initial predetermined position. The linear displacement member (104) is coupled to the weight elements (12) by force transmission mechanism (30). Force transmission mechanism (30) and transforming mechanism (100) are coupled to a vertical adjustment assembly (40) for compensating for the selective positional displacement of transforming mechanism (100).

12 Claims, 4 Drawing Sheets

MULTI-FUNCTION EXERCISE SYSTEM

BACKGROUND OF THE INVENTION

1. Field of the Invention

This invention is directed to an improved multi-function exercise system. In particular, this invention is directed to an improved multi-function exercise system wherein a user may exercise different portions of his or her body. Still further, this invention is related to an exercise system which includes a rotatively actuated bar assembly utilized in combination with a pulley system for reversibly lifting weight elements. More in particular, this invention is directed to an exercise system wherein the weight element is reversibly lifted in an identical direction irregardless of the direction which the actuating bar assembly is rotated from a first initial position. Additionally, this invention is directed to an exercise system having a force translation system for transforming the rotative displacement of the actuating bar assembly into a linear displacement of the weight elements. More in particular, this invention directs itself to an exercise system wherein the mechanism for transforming the rotative displacement of the actuating bar assembly into a linear displacement is adjustable with respect to the base frame of the exercise system without requiring manipulation of the weight elements or the actuating arm assembly.

2. Prior Art

Exercise systems using rotational mechanisms for linearly displacing a resistive force loading are well known in the art. The best prior art known to the Applicants include U.S. Pat. Nos. 1,028,956; 2,777,439; 2,855,199; 3,374,675; 3,647,209; 3,708,116; 3,721,438; 4,912,263; 4,208,049; 4,226,414; 4,226,415; 4,274,626; 4,275,882; 4,317,566; 4,328,964; 4,407,495; 4,478,411; 4,492,375; 4,500,089; 4,546,971; 4,568,078; 4,600,189; 4,600,196; and, 4,666,149, and Netherlands Patent #8005681.

In some prior art systems, like that disclosed in U.S. Pat. No. 4,600,189, there is provided a multi-function exercise system for reversibly linearly displacing a weight element responsive to a rotative displacement of an actuating arm. However, the weight element is only vertically lifted responsive to a rotation of the rotative displacement member from its initial position in a single direction, thus limiting the number of exercises which may be performed with the system, and requiring the user to always be positioned on one particular side of the machine.

Further, in such prior art systems, vertical displacement of the force translation system relative to the base frame results in rotation of the rotational displacement disk member to which the actuating bar assembly is coupled. This arrangement requires that the user uncouple the actuating bar assembly from the rotatable disk member prior to displacing the force translation system to prevent potentially injurious rotation of the actuating arm.

Still further, while such prior art systems may include a counterweight for maintaining the cable tension in the system, such prior art exercise systems do not provide a counterbalancing system for countering the combined weight of the force translation system and the actuating bar assembly, thereby forcing the user to support the weight thereof while attempting to adjust the positional location of the assembly.

In other prior art systems, such as that disclosed in U.S. Pat. No. 4,500,089, there is provided an exercise machine for performing a single group of muscles, those associated with the lower back of the user. While such systems incorporate a rotative displacement member coupled to a pair of sprockets, the sprockets being rotatively coupled for rotation about a common axis, for linearly displacing weight elements, such systems do not allow for bi-directional displacement of the rotative displacement member from its initial positional location. While such prior art systems may include variable radius cams as a rotative displacement member, such is not provided for substantially maintaining a constant resistance force, but in fact, deliberately vary the resistance force throughout the entire movement of the user's upper body.

SUMMARY OF THE INVENTION

An improved multi-function exercise system for reversibly displacing at least one resistive weight element responsive to a lifting force imparted to the weight element by a user. The improved multi-function exercise system includes a base frame as well as a force translation system displaceably coupled to the base frame and the weight element, for converting a rotative displacement force imparted by the user into the lifting force imparted to the resistive weight element. The force translation system includes an actuating bar assembly for applying the rotative displacement force in either of two opposite directions. The force translation system also includes a mechanism for transforming a reversible rotational displacement of the actuating bar assembly to a displacement of the resistive weight element. The transforming mechanism includes a rotatively displaceable member coupled to the actuating bar assembly for rotation about an axis responsive to rotation of the actuating bar assembly in (1) a clockwise direction, and (2) a counterclockwise direction. The weight element being linearly displaced in an identical direction when the rotatably displaceable member is rotatively displaced from a predetermined positional location in either clockwise or counterclockwise directions. The transforming mechanism is provided with a force transmission mechanism coupled to both the transforming mechanism and the weight element for displacing the weight element responsive to rotative displacement of the rotatively displaceable member. The force transmission mechanism includes a flexible cable system having a predetermined tension therein for coupling the weight element to the transforming mechanism. The force translation system is also provided with a vertical adjustment assembly releasably lockingly coupled to the base frame for adjusting the vertical positional location of the transforming mechanism relative to the base frame.

DESCRIPTION OF THE PREFERRED EMBODIMENTS

Figure 6:
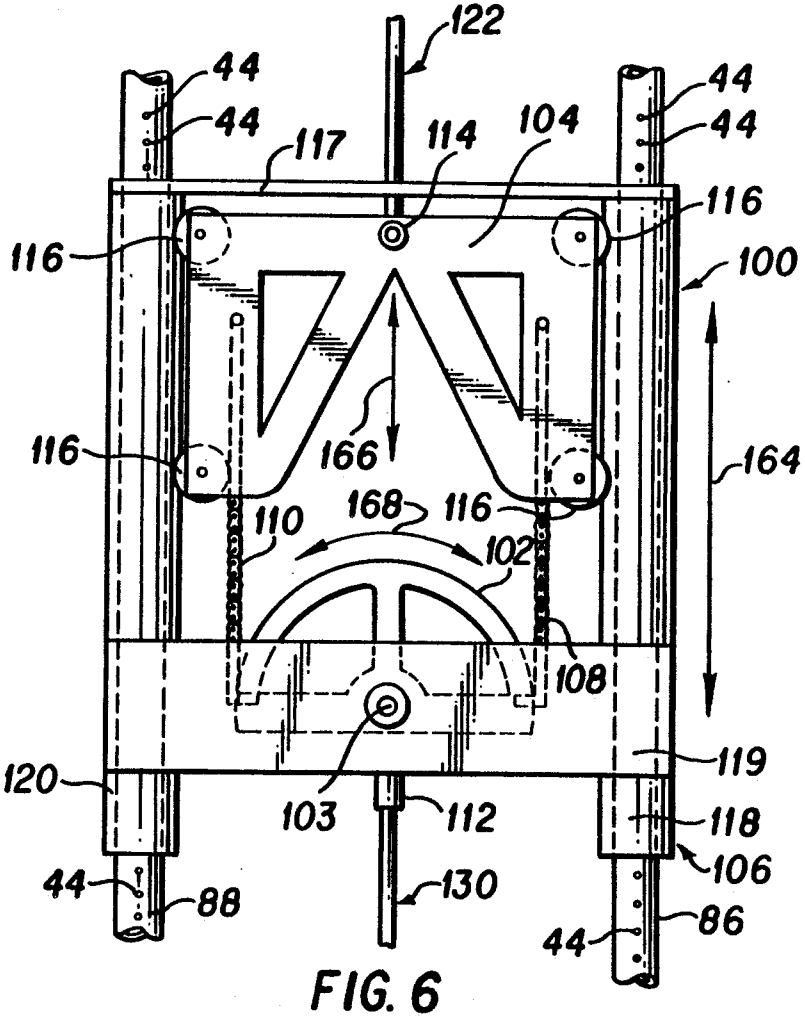
FIG. 6 is a frontal view partially in cut-away of the improved multi function exercise system showing the transforming mechanism in a first operating position; and, FIG. 7 is a frontal view partially in cut-away of the improved multi-function exercise system showing the transforming mechanism in a second position.

Referring now to FIGS. 1, 2, 3 and 4, there is shown improved multi-function exercise system 10 for reversibly displacing weight and/or force resistance elements 12 in substantially vertical direction 14 responsive to rotative displacement of actuating bar assembly 38 from an initial position in either of two opposite directions.

In overall concept, improved exercise system 10, at the user's discretion, may be used for a multiplicity of purposes, for exercise of different muscles in the user's body. In particular, improved exercise system 10 provides a wide range of adjustability, allowing the user to provide for a plurality of lifting force orientations to provide arm lifting capabilities, as well as leg imparted forces. Additionally, as will be seen in following paragraphs, improved multi-exercise system 10 simplifies the adjustment required for changing the system from one exercise setup to another. This simplification is provided by virtue of the force translation system having a displacement transforming mechanism 100 which linearly displaces one or more of the weight elements 12 in an identical direction regardless of the displacement direction of the actuating arm assembly 38 from an initial predetermined position.

Improved multi-function exercise system 10 includes a base frame 18 which includes a pair of rear support frame members 20 and 22 extending in a vertical direction 14 from respective lower horizontal frame members 26 and 28. Each of rear support frame members 20 and 22 are rigidly coupled to respective lower horizontal frame members 26 and 28. The uppermost ends of rear support frame members 20 and 22 are rigidly coupled to upper rectangular frame member 24, at a rear position 23 thereof. Lower horizontal frame members 26 and 28 are rigidly coupled each to the other by a pair of cross members 27 and 29. Lower horizontal frame members 26 and 28 extend horizontally from front cross member 29 for coupling with platform 25. Platform 25 is rigidly coupled to lower horizontal frame members 26 and 28 to provide a stable platform from which exercises can be performed and for support of accessory bench devices which the user may utilize in performing a specific exercise.

Figure 7:
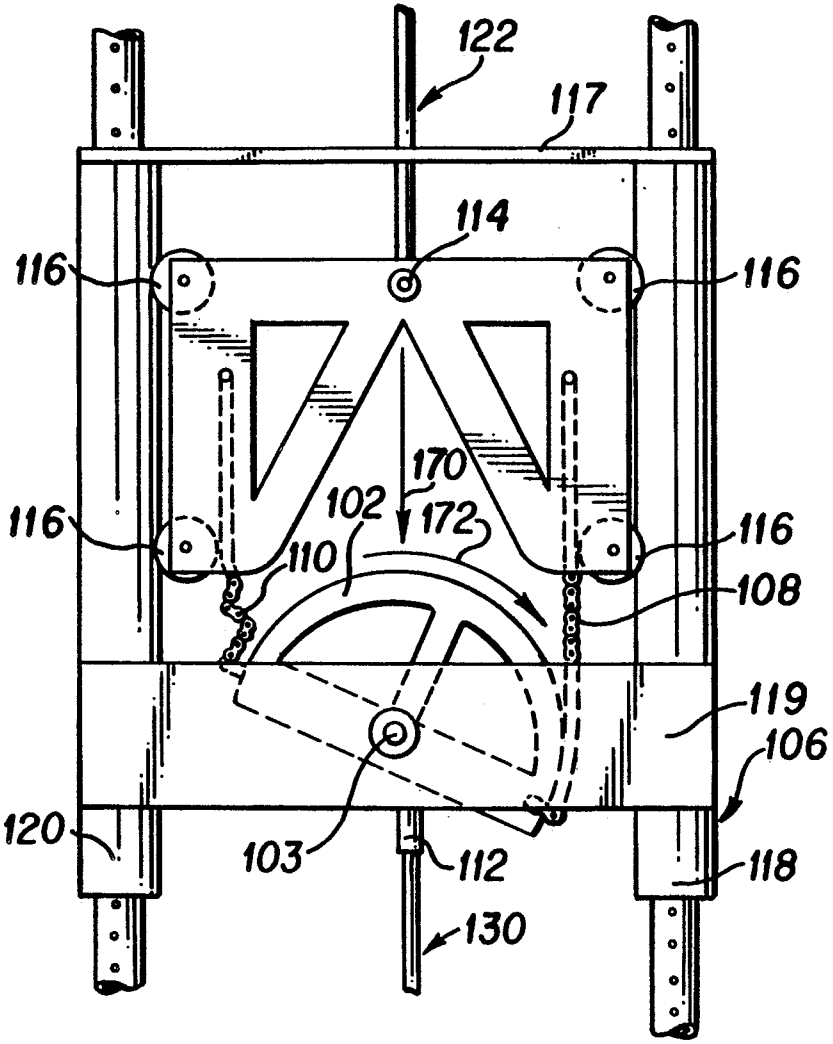

Improved exercise system 10 includes transforming mechanism 100 which is displaceably coupled to base frame 18 and weight elements 12 through the force transmission assembly 30. Force transmission mechanism 30 includes a displaceable frame assembly 106 slidingly coupled to a base frame 18, as is shown in FIGS. 6 and 7. Displaceable frame assembly 106 is releasably lockingly coupled to base frame 18 by means of handle and latch mechanism 42 having a spring biased pin member for releasable coupling with one of a plurality of through openings 44 formed in each of a pair of first post members 86 and 88.

Referring back to FIGS. 1–4, there is shown first post members 86 and 88 rigidly coupled to front cross member 29 and extending in vertical direction 14 for rigid coupling with a front portion 21 of upper rectangular frame member 24. Displaceable frame assembly 106 includes a pair of tubular members 118 and 120, being dimensioned for slidingly receiving respective first post members 86 and 88 longitudinally therethrough. Tubular members 118 are slidingly displaceable on post members 86 and 88 to allow selective vertical displacement, as indicated by direction arrow 164 in FIG. 6, of transforming mechanism 100. Handle and latch mechanism 42 provide the means for releasably lockingly engaging transforming mechanism 100 in a selected position with respect to post members 86 and 88.

Tubular members 118 and 120 are maintained in fixed spaced relationship by a pair of structural frame members 117 and 119. The uppermost portions of tubular members 118 and 120 are coupled each to the other by top frame member 117, while lower frame member 119 couples tubular members 118 and 120 each to the other adjacent their lowermost ends.

Referring now to FIGS. 6 and 7, there is shown, rotative displacement member 102 coupled to the shaft 103 for rotation responsive to a rotative displacement of the actuating bar assembly 38. Shaft 103 is pivotedly coupled to the lower frame member 119, allowing rotative displacement member 102 to rotate from its initial position, shown in FIG. 6, in either a clockwise or counterclockwise direction, as indicated by directional arrow 168. As rotative displacement member 102 is driven in either a clockwise or counterclockwise direction and then reversed, by a respective rotation of the actuating arm assembly 38, linear displacement member 104 is displaced vertically, as indicated by direction arrow 166.

Linear displacement member 104 is slidingly coupled to both tubular members 118 and 120 by means of a plurality of rollers 116 pivotedly coupled to linear displacement member 104. Linear displacement member 104 is coupled to rotative displacement member 102 by means of a pair of flexible linkage members 108 and 110. Each of flexible members 108 and 110 are coupled on one end to opposing sides of rotative displacement member 102, and coupled on the opposing end to linear displacement member 104.

As shown in FIG. 7, when rotative displacement member 102 is displaced from its initial position in a clockwise direction, as indicated by direction arrow 172, flexible member 108 is displaced in a downward direction, thereby causing linear displacement member 104 to be displaced downwardly, as indicated by direction arrow 170. Obviously, when rotative displacement member 102 is allowed to return to its initial position linear displacement member 104 is displaced in the opposite direction.

However, and very important to the inventive concept, when rotative displacement member 102 is rotated from its initial position in a counterclockwise direction flexible member 110 would thereby be displaced downwardly, again causing linear displacement member 104 to be pulled downward, as indicated by direction arrow 170.

Thus, it is seen that regardless of which direction rotative displacement member 102 is rotated from its initial starting position, linear displacement member 104 is displaced in the same direction, downwardly, as has been previously described. It can thus be understood that by coupling the linear displacement member 104 to a weight element 12, such can be displaced in the same direction, as a resistive load, when the actuating arm assembly is displaced from its initial position in either a clockwise or counterclockwise direction. Obviously, the elements may be transposed such that linear displacement member 104 is displaced upwardly responsive to the initial rotation of rotative displacement member 102.

Although actuating arm assembly 38 is releasably coupled to shaft 103 through a removable pin 68 extending through a pair of multiple disks, not shown, as is disclosed in U.S. Pat. No. 4,666,149, incorporated herein by reference, the bi-directional capability, as just described, alleviates the need for a great percentage of the adjustments required for adapting improved exercise system 10 to various different exercises. Further, while the linear displacement member 104 is displaceable relative to displaceable frame assembly 106, responsive to rotative displacement of the actuating arm assembly 38, displaceable frame assembly 106 is selectively displaceable relative to base frame 18.

It is well understood by those skilled in the art that in such systems wherein weight elements are utilized and the actuating system is displaceable with respect to the base frame, that some means of compensation for the change in length of the means coupling the actuator to the weight element must be provided. Improved multifunction exercise system 10 includes a vertical adjustment assembly 40 for compensating the force transmission mechanism 30 when the transforming mechanism 100 is repositioned relative to the base frame 18.

Referring to FIGS. 2–6, there is shown force transmission mechanism 30 having a flexible transmission member or first cable member 122 coupled on one end to linear displacement member 104 at a location 114. First cable member 122 may be coupled to frame member 104 by means well known in the art, such as by means of fasteners, welding or the like. The opposing end of cable member 122 is fixedly coupled to second pulley member 52, and wrapped thereon. A first ascending portion 124 of first cable member 122 extends from linear displacement member 104 to a first pulley member 36, rotatable about a first pulley axis 32, wherein cable 122 changes direction. The cable length extending from first pulley member 36 defines a second descending portion 126 of cable 122. Second cable portion 126 extends from first pulley member 36 to a second adjustment pulley 144 of displaceable pulley mechanism 140, wherein the cable direction is again changed to define an ascending third cable portion 128 extending from displaceable pulley mechanism 140. Third cable portion 128 extends between the second adjustment pulley 144 of displacement pulley mechanism 140 to the second pulley member 52.

Thus, as linear displacement member 104 moves downwardly responsive to rotation of rotative displacement member 102, tension is applied to the first cable member 122, thereby causing cable portion 128 to unwrap from second pulley member 52. This action in turn causes second pulley member 52 to rotate about its axis 34. Coupled to second pulley member 52, by means of a spacer 60, there is provided third pulley member 58 for rotation about the second pulley axis 34. Therefore, the rotative displacement of second pulley member 52 by the unwrapping of the portion 128 of cable member 122 results in a similar rotation of third pulley member 58.

A second cable member or weight coupling member 62 is fixedly coupled to third pulley member 58, on one end thereof and coupled on the opposing end to weight elements 12. Thus, as third pulley member 58 is rotatively displaced by the unwrapping of portion 128 of cable member 122 from second pulley member 52, cable member 62 is wrapped onto third pulley member 58, thereby shortening the length thereof and lifting the weight elements coupled thereto. Responsive to the actuating arm returning to its initial position, subsequent to the displacement which resulted in the lifting of weight elements 12, that portion of cable 62 which was wrapped on third pulley member 58, unwraps, by virtue of the tensile force applied thereto by weight elements 12, thereby resulting in rotation of third pulley member 58. Second pulley member 52 being fixedly coupled to third pulley member 58 by spacer 60 and rotatively displaceable about the same axis 34, rotates to rewrap portion 128 of first cable member 122 thereon.

Improved multi-function exercise system 10 includes vertical adjustment assembly 40 for compensation for a respective change in length of cable portions 126 and 128 of first cable member 122 responsive to repositioning of the transforming mechanism 100 relative to base frame 18. Vertical adjustment assembly 40 includes a third or vertical adjustment cable member 130 having one end fixedly coupled to displaceable frame assembly 106 at a connection 112, and the opposing end fixedly coupled to base frame 18. Third cable member 130 includes a first descending portion 132 extending from the displaceable frame assembly 106 to a first adjustment pulley 138. First adjustment pulley 138 allows the cable 130 to smoothly change direction, the cable portion extending from first adjustment pulley 138 defining a second ascending cable portion 134 which extends to the displaceable pulley mechanism 140. Third cable member 130 is rotatively coupled to displaceable pulley mechanism 140 by means of a second adjustment pulley 142, here again providing a smooth change in direction of third cable member 130 wherein a third descending portion 136 extends between second adjustment pulley 142 and the base frame 18, wherein the end thereof is fixedly coupled by means well known in the art.

It can now be seen that when transforming mechanism 100 is displaced vertically relative to base frame 18, the change in length of first cable member 122 portions 126 and 128 are equal and opposite to the change in cable length of third cable member 130 portions 134 and 136. The two second adjustment pulleys 142 and 144, being coupled one to the other in fixed spaced relation, but being vertically displaced together to maintain the tension in cable members 122 and 130 despite the apparent change in lengths in cable portions 126, 128 and 134, 136. This arrangement preventing any slack from developing in the respective cable members.

Figure 2:
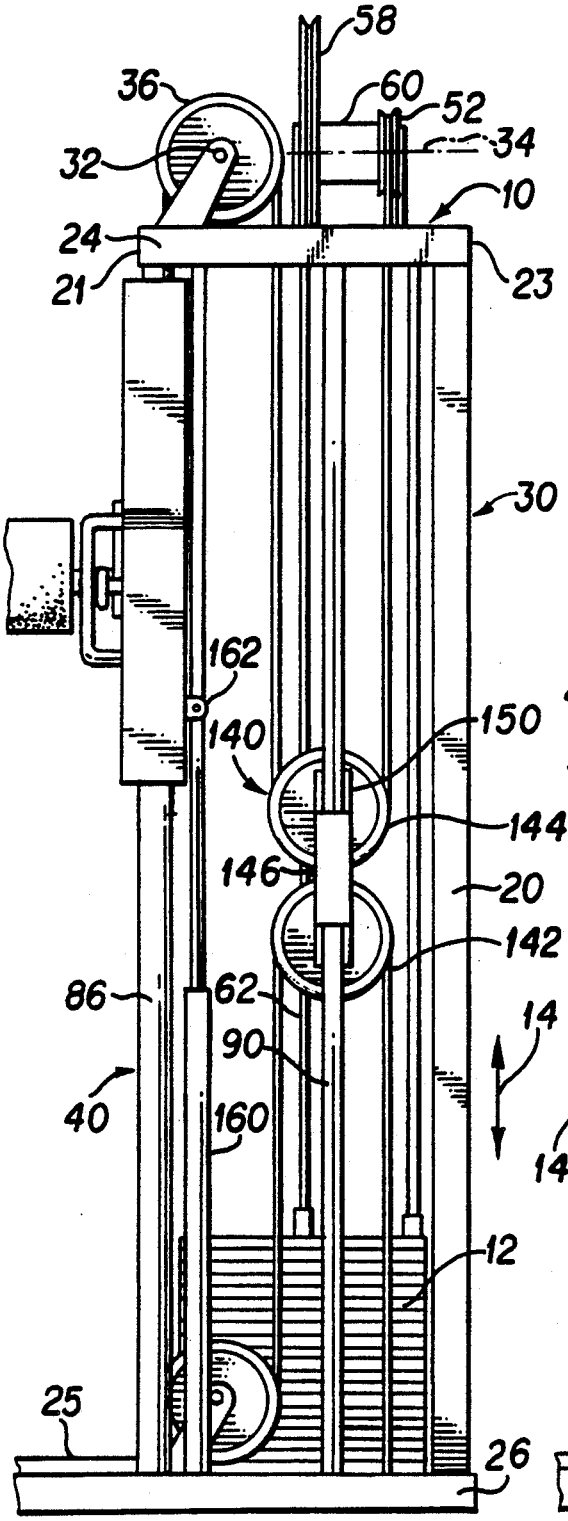
FIG. 2 is a plan view of one side of the improved multi-function exercise system.
Figure 3:
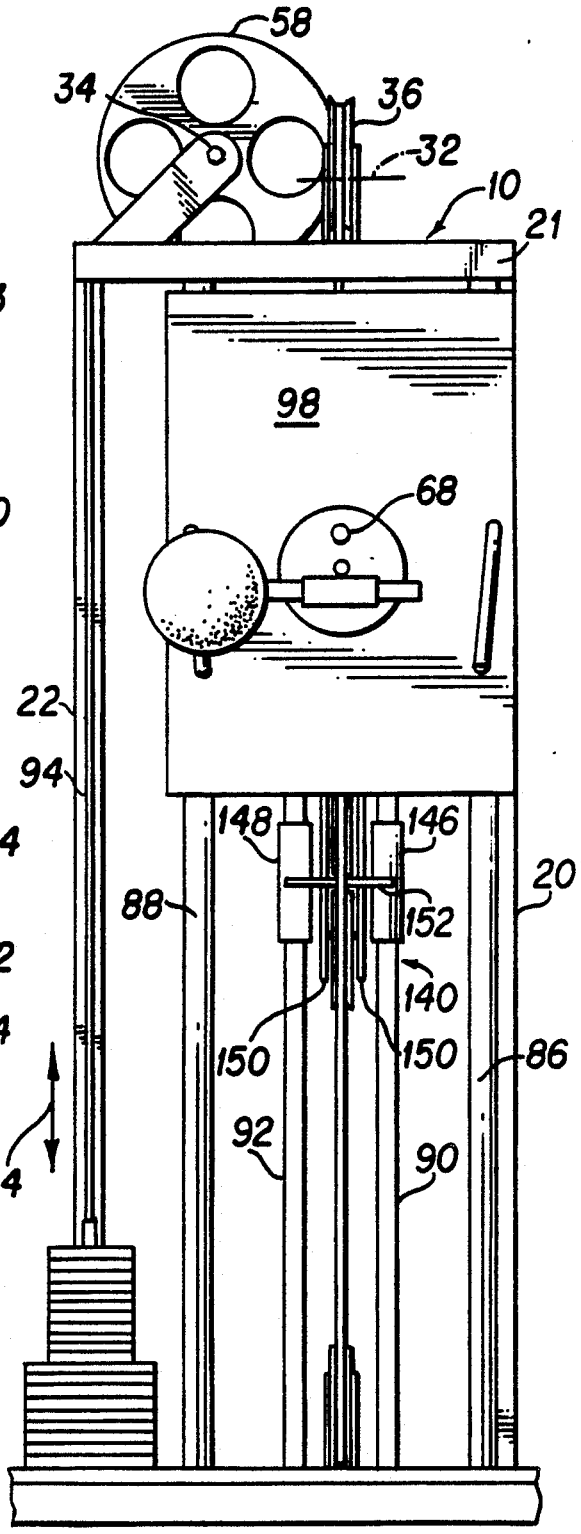
FIG. 3 is a frontal view of the improved multi-function exercise system.

As shown in FIGS. 2, 3 an 4, displaceable pulley mechanism 140 includes two second adjustment pulleys 142 and 144 coupled each to the other in fixed spaced relation by a pair of pulley supports 150, disposed on opposing sides thereof transverse their respective substantially parallel axes. Thus, each of second adjustment pulleys 142 and 144 are independently rotatable about their own axis, but coupled one to the other for displacement relative to base frame 18. The pulley supports 150 are each coupled to a respective slidable support member 146 and 148 by means of at least one pulley support cross bar 152. Each of slidable support members 146 and 148 are disposed coaxially over respective second post members 90 and 92. Each of slidable support members 146 and 148 are each formed by cylindrical tubular members having an internal diameter sufficiently large to be slidable over the second post members 90 and 92. Second post members 90 and 92 are rigidly joined at their lower end to base frame cross member 27, and on the opposing end to a support member, not shown, rigidly joined to upper rectangular frame member 24.

Vertical adjustment assembly 40 by means of third cable member 130, first adjustment pulley 138 and displaceable pulley mechanism 140 make possible the displacement of transforming mechanism 100 without causing a rotative displacement of the actuating arm assembly 38, as occurs in some prior art systems. Therefore, there is no requirement for the user to disengage the actuating arm assembly 38 from the rotative displacement member 102, by means of pin 68 in order to safely reposition transforming mechanism 100. The initial position of the actuating arm assembly 38, once set, remains the same irrespective of the positioning of transforming mechanism 100, and does not move while transforming mechanism 100 is being displaced from one position to another.

Vertical adjustment assembly 40 further includes a gas spring for counterbalancing the combined weights of transforming mechanism 100 and actuating arm assembly 38. Gas spring 160 is coupled on one end to base frame 18, and on the opposing end to displaceable frame assembly 106 for exerting a predetermined force substantially equal to the combined weights of transforming mechanism 100 and actuating arm assembly 38, thereby making substantially effortless the displacement of transforming mechanism 100 relative to base frame 18.

Transforming mechanism 100 is enclosed by a housing 98 which is coupled to displaceable frame assembly 106, having an opening formed therethrough through which the shaft 103 passes for coupling to the actuating arm assembly 38. The housing member 98 may also be provided with through openings through which the handle and latch mechanism 42 may be coupled to displaceable frame assembly 106. Housing 98 provides a complete enclosure for transforming mechanism 100, thereby preventing the user from inadvertently contacting the moving parts, rotative displacement member 102, flexible chain members 108 and 110, and linear displacement member 104, contained therein.

Figure 1:
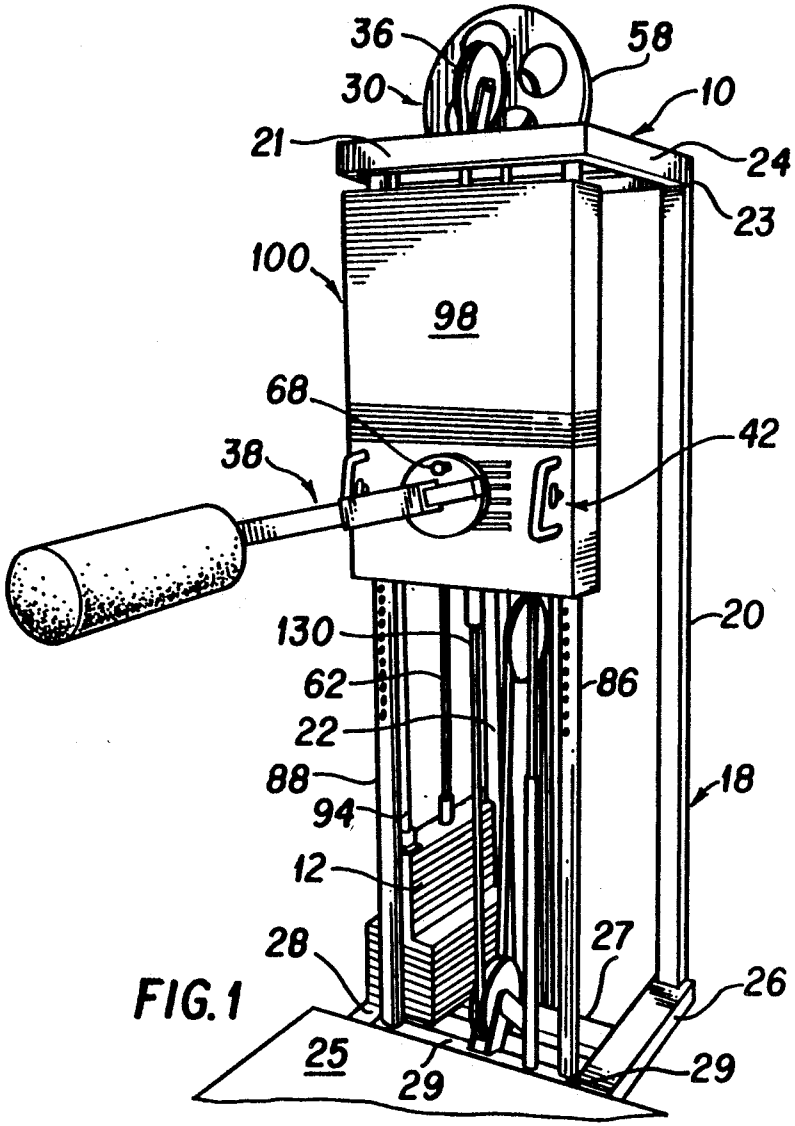
FIG. 1 is a perspective view of the improved multi-function exercise system.
Figure 4:
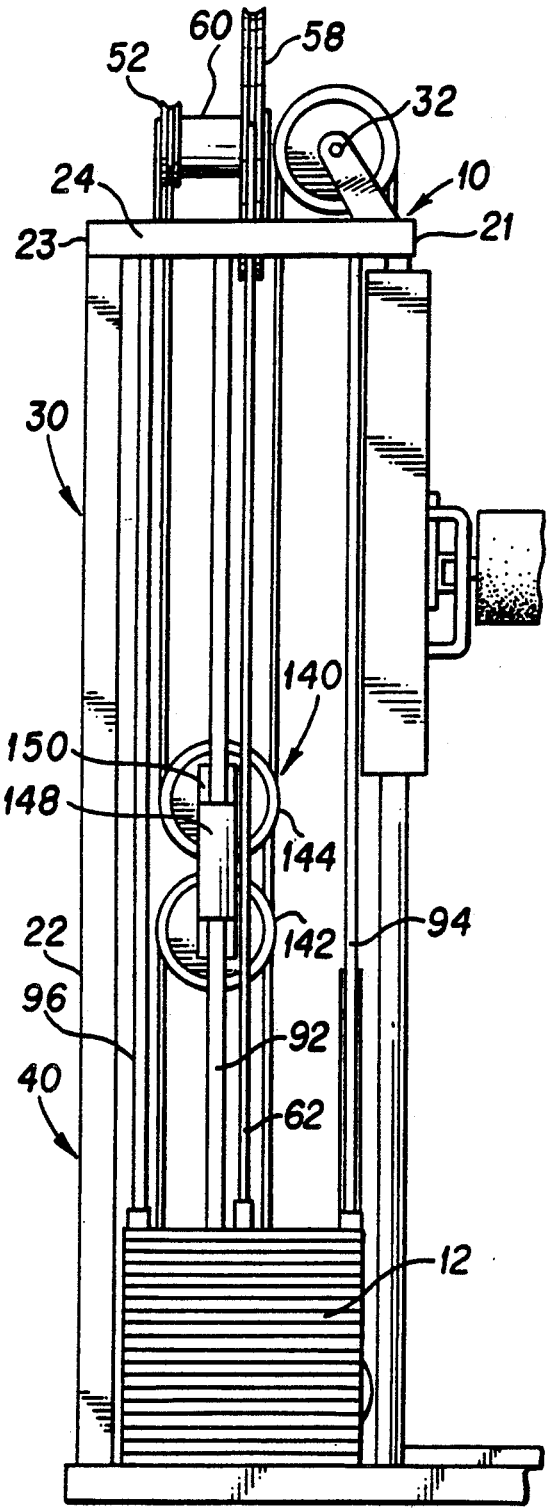
FIG. 4 is a plan view of an opposing side of the improved multi-function exercise system.
Figure 5:
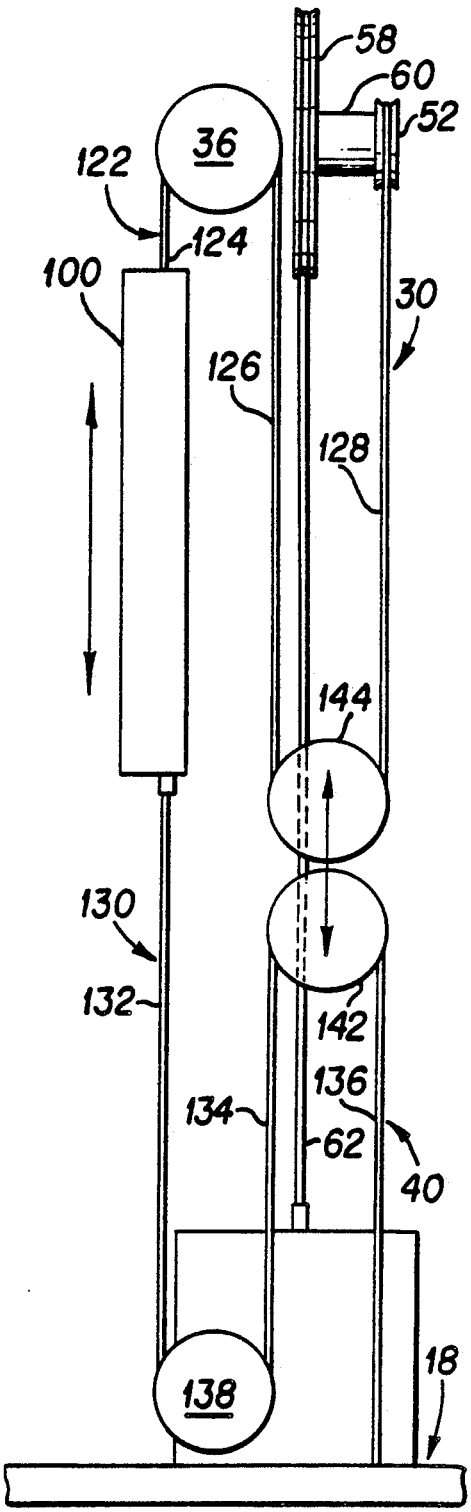
FIG. 5 is a schematic drawing of the cable and pulley system of the improved multi-function exercise system.

Referring now to FIGS. 1, 3 and 4, there is shown weight elements 12, which may be selectively coupled to second cable member 62 for providing a resistance force against which the user exercises various muscles or muscle groups. The means by which one or more of weight elements 12 may be selectively coupled to second cable member 62 is well known in the art, and not important to the inventive concept, as herein described. Obviously, other forms of resistive load may be substituted for weight elements 12, such as spring elements, elastic bands, hydraulic or pneumatic devices, or the like, all without departing from the inventive concept.

In order to provide smooth displacement of weight elements 12, each of weight elements 12 is slidingly coupled to a pair of third post members 94 and 96. Third post members 94 and 96 are rigidly coupled to lower horizontal frame member 28 and extend vertically upward for rigid coupling with upper rectangular frame member 24, thereby providing lateral support for weight elements 12 as they are displaced vertically.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular location of elements may be reversed or interposed, all without departing from the spirit or scope of the invention as defined in the appended claims.

What is claimed is:

1. An improved multi-function exercise system for reversibly displacing a predetermined weight load selected from a plurality of weight elements responsive to a lifting force imparted to said weight load by a user, comprising:

a base frame; and force translation means displaceably coupled to said base frame and said selected weight elements for converting a rotative displacement force in either of two opposite directions imparted by the user into said lifting force, said translation means including:

(a) actuating bar means for applying said rotative displacement force in either of said two opposite directions;

(b) means for transforming a reversible rotational displacement of said actuating bar means to a displacement of said selected weight elements, said transforming means including a rotatably displaceable member coupled to said actuating bar means for rotation about an axis responsive to rotation of said actuating bar means in (1) a clockwise direction, and (2) a counter-clockwise direction, said rotatably displaceable member having a predetermined positional location, said displacement of said selected weight elements being in an identical direction when said rotatably displaceable member is rotatively displaced from said predetermined positional location in either said clockwise or counter-clockwise directions, said rotatably displaceable member having a pair of opposing ends equidistantly spaced from said rotation axis, said transforming means further including a pair of flexible linkage members, each of said pair of flexible linkage members being coupled on a first end to a respective one of said opposing ends of said rotatably displaceable member, said flexible linkage members having a second end coupled to a linear displaceable member, said linear displaceable member being displaceable relative a positional location of said rotatably displaceable member from a first position to a second position responsive to rotation of said rotatably displaceable member from said predetermined positional location in either said clockwise or counter-clockwise directions;

(c) transmission means coupled to both said linear displaceable member and said selected weight elements for displacement thereof responsive to said rotative displacement of said rotatably displaceable member, said transmission means including flexible coupling means having a predetermined tension therein for coupling said selected weight elements to said linear displaceable member; and, (d) vertical adjustment means releasably lockingly coupled to said base frame for adjusting the vertical positional location of said transforming means relative to said base frame.

2. The improved multi-function exercise system as recited in claim 1 where said vertical adjustment means includes displaceable frame means releasably lockingly coupled to said base frame for supporting said transforming means and providing selective displacement thereof relative to said base frame.

3. The improved multi-function exercise system as recited in claim 2 where said displaceable frame means includes a pair of tubular support members disposed in fixed spaced relationship slidingly coupled to a respective pair of post members of said base frame.

4. The improved multi-function exercise system as recited in claim 3 where said vertical adjustment means includes at least one spring biased pin member passing through an opening formed of one of said pair of tubular support members for retractable insertion into one of a plurality of through openings formed in a respective post member.

5. The improved multi-function exercise system as recited in claim 2 where said vertical adjustment means further includes:

(a) a vertical adjustment flexible member fixedly coupled on one end to said displaceable frame means and on the opposing end to said base frame;

(b) a first adjustment pulley rotatively coupled to said displaceable frame means by said vertical adjustment flexible member; and, (c) displaceable pulley means rotatively coupled to said first adjustment pulley by said vertical adjustment flexible member for substantially maintaining said predetermined tension in said flexible coupling means of said transmission means.

6. An improved multi-function exercise system as recited in claim 3 where said displaceable pulley means includes a pair of second adjustment pulleys disposed in fixed spaced relationship each to the other, each of said pair of second adjustment pulleys being independently rotatable about a respective pulley axis, said pair of second adjustment pulleys being displaceable relative to said base frame responsive to displacement of said displacement frame means.

7. The improved multi-function exercise system as recited in claim 6 where a first pulley of said pair of second adjustment pulleys is rotatively coupled to said first adjustment pulley by said vertical adjustment flexible member.

8. The improved multi-function exercise system as recited in claim 7 where said linear displaceable member is slidingly coupled to said displaceable frame means.

9. The improved multi-function exercise system as recited in claim 8 where said transmission means includes:

(a) a first pulley member rotatively coupled to said linear displaceable member for rotation about a first pulley axis;

(b) a second pulley member rotatively coupled to said first pulley member, said second pulley member being rotatable about a second pulley axis; and, (c) a third pulley member secured to said second pulley member and said weight element for rotation about said second pulley axis.

10. The improved multi-function exercise system as recited in claim 9 where said flexible coupling means includes a flexible transmission member having one end fixedly coupled to said linear displacement member and an opposing end fixedly coupled to said second pulley member, said flexible transmission member rotatively coupling a second pulley of said pair of second adjustment pulleys with both said first pulley member and said second pulley member for substantially maintaining a predetermined tension in said flexible transmission member.

11. The improved multi-function exercise system as recited in claim 10 where said flexible coupling means further includes a flexible weight coupling member respectively coupled to said selected weight elements and said third pulley member on opposing ends thereof.

12. The improved multi-function exercise system as recited in claim 11 where said vertical adjustment means further includes gas spring means coupled to said displaceable frame means for counter-balancing a weight of said transforming means.

* * * * *